US005597675A

United States Patent [19]

Arudi et al.

[11] Patent Number: 5,597,675

[45] Date of Patent: Jan. 28, 1997

[54] DISPERSING POLYMERS FOR PHTHALOCYANINE PIGMENTS USED IN ORGANIC PHOTOCONDUCTORS

[75] Inventors: Ravindra L. Arudi, Woodbury; John C. Haidos, St. Paul, both of Minn.

[73] Assignee: Imation Corp., Woodbury, Minn.

[21] Appl. No.: 634,539

[22] Filed: Apr. 18, 1996

Related U.S. Application Data

[62] Division of Ser. No. 414,278, Mar. 31, 1995, Pat. No. 5,536,611.

[51] Int. Cl.[6] ..... G03G 5/06

[52] U.S. Cl. ..... 430/134; 430/130; 430/136

[58] Field of Search ..... 430/130, 134, 430/136

[56] References Cited

U.S. PATENT DOCUMENTS 5,264,312 11/1993 Stolka et al. ..... 430/130

5,332,644 7/1994 McNamara ..... 430/134

FOREIGN PATENT DOCUMENTS 61-5253 1/1986 Japan ..... 430/130

63-81359 4/1988 Japan ..... 430/130

*Primary Examiner*—Roland Martin

*Attorney, Agent, or Firm*—Arlene K. Musser

[57] ABSTRACT

A phthalocyanine pigment dispersion using a dispersing polymer having pendant quaternary ammonium salt groups to form a highly dispersed and stable millbase is described. The pigment dispersion is compatible with poly(vinylbutyral) resins and stable in ketone solvents. The pigment dispersion is particularly useful as a charge-generating or charge-transport material in an organic photoconductor construction.

16 Claims, No Drawings

DISPERSING POLYMERS FOR PHTHALOCYANINE PIGMENTS USED IN ORGANIC PHOTOCONDUCTORS

This is a division of application Ser. No. 08/414,278 filed Mar. 31, 1995 now U.S. Pat. No. 5,536,611.

BACKGROUND OF THE INVENTION

FIELD OF THE INVENTION

This invention relates to dispersing polymers for phthalocyanine pigments. In particular, this invention relates to dispersing polymers that provide highly dispersed and stable methyl ethyl ketone dispersions of phthalocyanine pigments for use in electrophotographic applications.

The present invention also relates to an electrophotographic organic photoconductor using phthalocyanine pigments dispersed in a dispersing polymer to provide charge-transport and charge-generating characteristics in a high performance organic photoconductor.

BACKGROUND OF THE INVENTION

The phthalocyanine class of pigments has proven to be very useful colorants in a wide variety of applications. Because of their color purity and transparency, the phthalocyanine pigments are well known for their excellent color matching capabilities in applications, such as, color proofing, printing inks, colored films, liquid electrostatic toners, etc.

In addition, phthalocyanine pigments dispersed in a polymeric binder system are useful in electrophotography as charge generating/transporting materials in organic photoconductors. Electrophotography forms the technology base for a variety of well known imaging processes, including photocopying and laser printing. The process involves placing a uniform electrostatic charge on a photoconductor element, imagewise exposing the photoconductor element to light thereby dissipating the charge in the exposed areas to form an electrostatic latent image, developing the resulting electrostatic latent image with a toner, and transferring the toned image from the photoconductor element to a final substrate, such as paper, either by direct transfer or via an intermediate transfer material.

Photoconductor elements based on organic materials have received significant emphasis due to their flexibility, the dark resistivity and radiation sensitivity of organic materials, and lower cost of materials and manufacturability. See for example, Borsenberger, P. M., et al, *Photoreceptors: Organic Photoconductors*, Handbook of Imaging Materials, Ed. A. S. Diamond, Marcel Dekker, Inc., New York, N.Y. Chap. 9, 379(1991); and Borsenberger, P. M., et al, *Photoreceptors*, Organic Photoreceptors for Imaging Systems, Marcel Dekker, Inc., New York, N.Y., Chap. 11,301 (1993). In particular, both metal contained and metal-free phthalocyanine pigments have been the focus of extensive research as charge generating and charge transporting materials in both negatively and positively charged organic photoconductors. X-metal-free phthalocyanine pigments have been used both for their charge generating and charge transporting functions in single layer constructions, and for their charge generating function in dual layer constructions.

Phthalocyanine pigments are one of more difficult classes of pigments to form highly dispersed and stable liquid dispersions, especially in methyl ethyl ketone (MEK) solvent. The use of MEK is desirable since there is a preponderance of manufacturing experience in both dispersion and coating processes for a wide variety of product applications. In addition, little residual solvent is left behind in coatings upon drying of MEK coating solutions because of its volatility.

The quality of the phthalocyanine dispersion has a direct relationship upon the performance of the organic photoconductor. Typically organic photoconductors use phthalocyanine pigments dispersed in polyvinylacetal binders. Solvents such as tetrahydrofuran, methylene chloride, or one of the cellosolve based solvents are primarily used in these applications to achieve efficient charge transport properties.

Many attempts have been made to improve both the quality and the stability of phthalocyanine dispersions. In U.S. Pat. No. 5,364,727, a single layer photoconductor is described containing a distribution of phthalocyanine pigment and arylamine sensitizer in a polymeric binder having polar and non-polar functional moieties. The polar function of the polymer, comprising esters, carbonyl and amide groups, is believed to stabilize the phthalocyanine pigment dispersion. The non-polar function of the polymer, comprising alkanes and alkenes, is believed to provide absorption of the hydrocarbon solvent of the liquid toner. The only solvent disclosed is a chlorinated solvent, specifically dichloromethane.

Incorporation of an ammonium component into a pigment treatment resin is described in U.S. Pat. No. 4,618,554. The treatment resin comprises an aqueous soluble acrylic resin with a pendant alkyl ammonium group attached. A pigmented photoreceptor solution is produced using a two step process. The pigment is first treated by mixing the acrylic resin with the pigment under harsh acid conditions. The material is then isolated and neutralized before dispersing it into a solvent based photoreceptor coating solution.

U.S. Pat. No. 5,028,506 describes the addition of a low molecular weight ammonium salt to a charge-generating (pigment) dispersion to provide an electrophotographic photoreceptor with improved repetitive characteristics without lower the sensitivity. The ammonium salt is a post additive to the pigment dispersion and not a dispersing aide for improving dispersion quality.

U.S. Pat. No. 5,087,540 describes a phthalocyanine/poly-(vinylbutyral) dispersion for organic photoconductor applications having a "molecularly dissolved" state, which is necessary for an effective photoconductor performance. In addition, methyl ethyl ketone is identified as an "undesirable solvent" for metal-free phthalocyanine pigment dispersions.

The solvents disclosed in the art which give acceptable phthalocyanine dispersions present several toxicological and environmental issues. The chlorinated solvents are well known to cause environmental problems. In addition, the chlorinated solvents are suspected carcinogens and have been banned from use in some jurisdictions. Cellosolve solvents are suspected as carcinogens and teratogens. MEK has better toxicological and environmental properties compared to the chlorinated and cellosolve solvents. Tetrahydrofuran (THF), if not properly treated to prevent the formation of peroxides, can cause an explosion. Even when anti-oxidants are used with THF their effect is only temporary; thus requiting special handling during storage and solvent recovery operations. Unlike THF, MEK does not form peroxides easily in the presence of oxygen, light or heat.

Polymers with attached ammonium groups or ammonium compounds have also been used in the production of dry electrostatic toners. In U.S. Pat. Nos. 4,299,898; and 4,224, 396; dry electrostatic toners are described where a pigment is dispersed in a resin comprising an acrylate polymer with a quaternary ammonium salt attached to the polymer. In U.S. Pat. Nos. 5,215,848; 4,221,856; and Re. 32,88:3; dry toners are described where a quaternary ammonium compound is added to the dispersion. However, the primary function of the quaternary ammonium groups in each of the above applications is to impart a stable positive charge on the toner. There is no indication that the use of quaternary ammonium salts may be useful in a liquid dispersion or for improved performance of a photoconductive layer in a photoconductor.

U.S. Pat. No. 5,1:39,892 describes a magnetic recording media which uses a vinyl chloride copolymer having pendant quaternary ammonium groups to disperse magnetic particles. The disclosure does not contemplate the use of such polymers as a phthalocyanine pigment dispersant.

There is a need for a dispersing polymer which can form a highly dispersed and stable phthalocyanine pigment dispersion in a more suitable solvent.

SUMMARY OF THE INVENTION

The present invention provides a highly dispersed and stable phthalocyanine pigment dispersion comprising a phthalocyanine pigment, a dispersing polymer composed of a polymeric material having a plurality of pendant quaternary ammonium salt groups, and an organic solvent. The organic solvent may be an ether, ester or ketone solvent. Additionally, the dispersion may contain a poly(vinylbutyral) binder.

In a preferred embodiment the dispersing polymer comprises an alkyl acrylate monomer unit, an alkyl methacrylate monomer unit, a hydroxyalkyl acrylate monomer unit, and an alkyl methacrylate monomer unit having a pendant quaternary ammonium salt group. The alkyl methacrylate monomer unit having a pendant quaternary ammonium salt group preferably has the following structure:

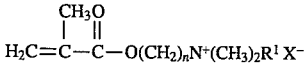

$$H_2C{=}\overset{CH_3}{\overset{|}{C}}{-}\overset{O}{\overset{\|}{C}}{-}O(CH_2)_nN^+(CH_3)_2R^1\,X^-$$

where; n is 1 to 20, preferably 1 to 10, most preferably 1 to 5; $R^1$ is an alkyl group having 1 to 30 carbons, preferably 1 to 20 carbons; and X is a counter anion.

In another embodiment, the present invention provides an electrophotographic organic photoconductor element comprising; an electroconductive substrate, a photoconductive layer comprising a phthalocyanine pigment, a dispersing polymer composed of a polymeric material having a plurality of pendant quaternary ammonium salt groups, and a binder.

In still another embodiment, the present invention provides a method for producing an organic photoconductor comprising the steps of;

a) preparing a photoconductive layer solution by combining a phthalocyanine pigment dispersion comprising a phthalocyanine pigment, a dispersing polymer composed of a polymeric material having a plurality of pendant quaternary ammonium salt groups and an organic solvent with a binder and a crosslinking agent; the organic solvent may be an ether, ester or ketone solvent;

b) coating the photoconductive layer solution on an electroconductive substrate;

c) drying the coating; and d) crosslinking the coating.

Other aspects, benefits and advantages of the present invention are apparent from the following detailed description, examples, and claims.

DETAILED DESCRIPTION OF THE INVENTION

The pigment dispersion of this invention comprises a phthalocyanine pigment, a dispersing polymer comprising a polymeric material having a plurality of pendant ammonium salt groups and a solvent. In particular, the polymeric material comprises an alkyl acrylate monomer unit, an alkyl methacrylate monomer unit, a hydroxyalkyl acrylate monomer unit and an alkyl methacrylate monomer unit have a quaternary ammonium salt group.

The pigment dispersion of this invention has been found to be particularly useful in a photoconductive layer of an electrophotographic organic photoconductor. The organic photoconductor can be of any type, such as a drum, belt, sheet, or any other construction known in the art. The organic photoconductor of this invention comprises a photoconductive layer deposited upon an electroconductive substrate. Electroconductive substrates for photoconductive systems are well known in the art. There are two primary classes of electroconductive substrates: (1) self-supporting layers or blocks of conducting metals, or other highly conducting materials; and (2) insulating materials such as polymer sheets, glass, or paper to which a thin conductive coating, e.g. vapor coated aluminum, has been applied.

It is very difficult to achieve a stable functional dispersion of phthalocyanine pigments for use in organic photoconductor applications, especially in ketone solvents. The type of phthalocyanine pigment, the dispersing polymer, the solvent and additional binders all contribute to the stability and quality of the final dispersion. There are three primary processes that take place in forming a dispersion: 1) wetting out of the pigment surface with a binder and/or wetting agent (displacement of the pigment/air interface with the pigment/medium interface); 2) mechanical disaggregation; and 3) stabilization of the dispersion. It has been found in the present invention that quaternary ammonium containing polymers are very effective in wetting the pigment surface and preventing agglomeration of the pigments both during and after the milling process. To be an effective organic photoconductor, a highly dispersed dispersion with appropriate fineness needs to be achieved. Once the desired dispersion fineness is achieved, additional binder or additives are added to provide longer term stability of the dispersion. The preferred binder has a higher molecular weight and higher viscosity than the milling medium.

If a stable dispersion is initially achieved in the milling process, the dispersion is less susceptible to agglomeration when other binders are added to the dispersion. This is important because it is highly desirable to add a variety of different types of binders to achieve different properties in the formulation and final product. For example, a binder may be added to improve coatability of the solution, film forming properties, abrasion resistance, curing, release or adhesion characteristics, etc. Suitable binder resins include polyesters, polyurethanes, polyvinyl acetate, polyvinyl chloride, polyvinylidene chloride, polycarbonates, poly(vinylbutyral), polyvinyl acetoacetal, polyvinyl formal, polyacrylonitrile, polymethyl methacrylate, polyacrylates, polyvinyl carbazoles, copolymers of monomers used in the abovementioned polymers, styrene maleic anhydride copolymers, styrene maleic anhydride half-ester copolymers, vinyl chloride/vinyl acetate/vinyl alcohol terpolymers, vinyl chloride/vinyl acetate/maleic acid terpolymers, ethylene/vinyl acetate copolymers, vinyl chloride/vinylidene chloride copolymers, cellulose polymers and mixtures thereof.

Phthalocyanine pigments used in this invention may be any phthalocyanine pigment having the appropriate charge-transport and charge-generating characteristics for the desired application in electrophotography. For example, a phthalocyanine pigment having an absorption in the range of the radiation source output is chosen to achieve charge-generation properties. Suitable pigments include metal-free phthalocyanines, metal phthalocyanines and mixtures thereof. A more detailed description of phthalocyanines for photoconductive applications can be found in Borsenberger, P. M., et al, *Photoreceptors: Organic Photoconductors*, Handbook of Imaging Materials, Ed. A. S. Diamond, Marcel Dekker, Inc., New York, N.Y., Chap. 9, p. 411 ( 1991 ); and Borsenberger, P. M., et al, *Photoreceptors*, Organic Photoleceptors for Imaging Systems, Marcel Dekker, Inc., New York, N.Y., Chap. 11, p. 339 (1993). The synthesis of phthalocyanine pigments is well-known in the art and has many crystal forms; for example, α–, β–, γ–, δ–, ϵ–, τ–, and X-forms are known. For use in the photoconductive layer of this invention, the τ– and X-forms of metal-free phthalocyanine are preferred when used in conjunction with a 780 nm coherent radiation source.

Several attempts have been made to achieve stable phthalocyanine dispersions. The phthalocyanine pigment surface is well known to be hydrophobic and hence the pigment agglomerates can be broken down in organic solvents, even in the absence of binders. However, the particle size distribution would be too wide and this affects performance, as a result of negative effects from both the undersized and oversized particles. In a photoconductive application, the undersized particles would be much more conductive resulting in a higher residual surface potential after erase and in a greater loss of initial charge-up potential after the dark decay period, than is desirable. The oversized particles cause problems during the filtration of the dispersion or coating solutions. Substantial amounts of pigment could be lost in the filter leading to inconsistent pigment content in the photoconductive layer. In addition, the oversized particles would not be as photosensitive leading to insufficient carrier generation efficiency. The addition of a dispersing polymer is highly desirable to provide a stabilizing effect, and to control particle size and distribution. To achieve a stable dispersion the interaction between the pigment surface and the dispersing polymer is optimized. Hydroxyl-groups on the polymer backbone provide some interaction, such as in the poly(vinylbutyral) resins; however, the interaction is not sufficient to provide good coverage of the pigment.

Quaternary ammonium halide salt groups interact strongly with the pigment surface. When a dispersing polymer is used having pendant quaternary ammonium halide salt groups, the pigment becomes encapsulated in the dispersing polymer due to this strong interaction between the pigment and ammonium salt group. The dispersing polymer containing pendant ammonium halide salt groups stabilizes the pigment dispersion via charge stabilization due to the quaternary ammonium salt groups and steric stabilization due to the polymer chains. By optimizing the level of quaternary ammonium salt groups on the polymer backbone, one can obtain desired coverage of the pigment particles during and after the milling process to achieve optimum particle size distribution, rheology, and stability. In addition, the milling time can be reduced providing a more efficient process.

The pigment and dispersing polymer may be dispersed using any known dispersing techniques, such as, sandmilling, ball milling or simply shaking on a paint shaker with a milling media. Preferred methods are sandmilling and ball milling since the dispersion is formed in the solvent to be used in the final formulation. Most preferred is sandmilling due to its higher efficiency and consistency.

The dispersing polymer is a polymeric material having a plurality of quaternary ammonium salt pendant groups attached to the polymer. The polymeric material may be based on a combination of monomer units. Suitable vinyl monomer units include acrylates, methacrylates, vinyl acetates, vinyl chlorides, acrylamides, styrene, acrylonitrile, etc. Suitable acrylate and methacrylate monomer units include; acrylic and methacrylic acid esters of alkyl radicals containing from 1 to 20 carbon atoms. The alkyl radicals may contain substitutents such as hydroxyls, alkyl ethers, aryl ethers, alkyl amines, aryl amines, halogens, and thioethers. A preferred dispersing polymer comprises quaternary ammonium alkyl acrylates or quaternary ammonium alkyl methacrylates monomer units and monomer units selected from the list of alkyl acrylates, alkyl methacrylates, hydroxyalkyl acrylates, hydroxyalkyl methacrylates, aminoalkyl acrylates, aminoalkyl methacrylates, vinyl acetates and vinyl chlorides. The most preferred dispersing polymer comprises the following monomer units; alkyl acrylate, alkyl methacrylate, hydroxyalkyl methacrylate, and quaternary ammonium alkyl acrylate or quaternary ammonium alkyl methacrylate. An example of a commercially available dispersing polymer is EC-130 available from Sekisui Chemicals and described in U.S. Pat. 5,139,892.

The alkyl acrylate and methacrylate monomers are chosen for their reactivity, solubility, compatibility with other types of polymers, the glass transition temperature range and molecular weight ranges. A preferred methacrylate monomer is methyl methacrylate and typically comprises 10–50% by weight of the dispersing polymer, and preferably 20–40%. A preferred alkyl acrylate is butyl acrylate and typically comprises 10–60% by weight of the dispersing polymer, and preferably 20–50%.

The hydroxyl-substituted alkyl acrylates and methacrylates are chosen to impart hydroxyl functionality to the polymer which can be used as a curing site. Preferred hydroxyl-substituted alkyl acrylates include hydroxybutyl acrylate, hydroxypropyl acrylate and hydroxyethyl acrylate; most preferred being hydroxybutyl acrylate. The hydroxyl-substituted alkyl acrylate or methacrylate component comprises 3–30% by weight of the dispersing polymer, and preferably 5–15%.

The hydroxyl-group can be reacted directly with a crosslinking agent, such as isocyanate compounds. Alternatively, the hydroxyl-group can be derivatized with an unsaturated group, such as isocyanatoethyl methacrylate (IEM) or 1-(1-isocyanato-1-methylethyl)-3-(1-methylethenyl)-benzene (TIP) and then cured by irradiating with electromagnetic radiation, such as ultraviolet radiation or electron beam. In this approach it may be necessary to add a photoinitiator or combination of initiator and photosensitizer to assist in radical initiation. Photoinitiator systems are well known in the art.

The preferred vinyl monomers having tetra-alkyl quaternary ammonium salt groups for use in this invention include halide salts of the following monomers; 3'-trimethylammonium, 2'-hydroxy-n-propyl methacrylate; 2'-trimethylammonium ethyl methacrylate; dimethyldiallyl ammonium salt; vinylbenzyltrimethyl ammonium salt; and monomers having the following general structure.

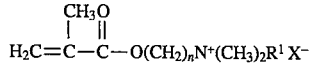

where; n is 1 to 20, preferably 1 to 10, more preferably 1 to 5; $R^1$ is an alkyl group having 1 to 30 carbons, preferably 1 to 20 carbons; and X is a counter anion.

The halide counter anion includes; chloride, bromide, and iodide. Other suitable counter anions non-exclusively include sulfates, organosulfates, phosphates and organophosphates. As discussed earlier, the ammonium salt group functions as an interactive site with the pigment surface to provide solution stability. Due to its polar characteristics it also provides charge stabilization. The effect of incorporation of an ammonium pendant group in the dispersing polymer can be clearly realized in Examples 1 and 2 below. Uniform dispersions can be achieved by milling with a polymer containing pendant quaternary ammonium salt groups in either tetrahydrofuran or methyl ethyl ketone solvents.

In the present invention, useful organic photoconductors were produced using phthalocyanine dispersions comprising an X-metal-free phthalocyanine pigment, a polymer containing pendant quaternary ammonium salt groups and methyl ethyl ketone. As the Examples below illustrate highly dispersed and stable phthalocyanine pigment dispersions can be achieved by using a dispersing polymer containing pendant quaternary ammonium salt groups during the milling process. The percentage of vinyl monomers containing ammonium groups added to the polymer is chosen such that a sufficient amount of ammonium groups are present to wet out the surface of the pigment without causing detrimental effects on the dispersion or final photoconductor performance. The percentage of vinyl monomer units containing quaternary ammonium salt groups incorporated into the dispersing polymer should be between 0.5 to 5.0% by weight, and preferably 1.0 to 3.0%.

The dispersing polymer used in this invention may be synthesized by free radical polymerization of the monomer units. The monomer units are simply combined in a suitable vessel in the presence of a thermal radical initiator. The mixture is then allowed to mix at a constant temperature (approximately 60° C.) until the reaction is completed. Suitable thermal radical initiators include azobisisobutylnitrile (Vazo 64, available from DuPont Chemicals, Wilmington, Del.), benzoyl peroxide, t-butyl peroxyoctoate, and t-butyl hydroperoxide. The resultant dispersing polymer has a number average molecular weight of about 25,000 and a polydispersity of about 2. The glass transition temperature is typically between 40°–60° C.

It is preferred in the practice of this invention to initially mill the phthalocyanine pigment with the dispersing polymer to form a millbase; then add other binders as a secondary step in the process. Once the phthalocyanine pigment is dispersed into the dispersing polymer, a highly dispersed and stable pigment dispersion is achieved which is more tolerant of additional binders. Therefore, binders such as poly(vinylbutyral), which do not by themselves form useful pigment dispersions in methyl ethyl ketone, can be added as a secondary binder without affecting the performance of the organic photoconductor or the stability of the dispersion.

The photoconductive layer of an electrophotographic photoconductor comprises a pigment dispersion and a binder. It may also contain additives, such as anti-oxidants, surfactants, crosslinking agents, stabilizers, coating aids, viscosity modifiers, adhesion promoters, and release agents.

In a photoconductor application the binder is chosen for its low impurities as well as molecular weight, viscosity, electrical properties and glass transition temperature. Suitable binders include; polyesters, acrylic copolymers, polycarbonates, polyurethanes, poly(vinyl chloride) copolymers and poly(vinylbutyral). The butyral resins are particularly useful for this application and are available from several sources of supply. A preferred set of poly(vinylbutyral) resins include the Mowital™ resins (available from Hoechst Celanese, Charlotte, NC), for example Mowital™ B60HH which has the following properties: butyral content greater than 80%; hydroxyl content of 10–15%; less than 2% volatile impurities; average molecular weight of about 50,000 and a glass transition temperature of 60°–100° C.

Crosslinking agents may be added to the photoconductive layer to provide robustness to the dried and cured coating. They also lower the free hydroxyl content in the polymer resulting in improved electrical properties. Suitable crosslinking agents include diisocyanates, polyisocyanates, and dialdehydes. The isocyanate crosslinking agents are preferred due to their high reactivity and the toughness and flexibility imparted into the final coating.

The photoconductive layer may be deposited upon the electroconductive substrate using a variety of coating methods, such as ring coating, extrusion die coating, reverse roll coating, and curtain coating. The coating is then dried with heated air or any other methods known in the art to remove solvents from a coating. Application of heat may also be used to cure the coating if a thermal crosslinking agent is present in the formulation. The crosslinking process can be achieved by supplying sufficient heat in the drying process or by a secondary heating process. Alternatively, the coating may be crosslinked by irradiating with electromagnetic radiation if the crosslinking agent has unsaturated sites which are capable of combining through photo-induced radical initiation. The photoconductive layer has a dry coating thickness between 3 to 12 microns, and preferably between 6 to 9 microns.

Optionally, the photoconductor of this invention may further comprise an outermost protective barrier layer positioned adjacent to the photoconductive layer. The protective barrier layer protects the photoconductor layer from the toner carrier liquid and other compounds which might damage the photoconductor. The protective barrier layer also protects the photoconductive layer from damage that could occur from repetitive charging of the photoconductor with a high voltage corona, and abrasion from handling and transport during the imaging process. The protective barrier layer must not significantly interfere with the charge dissipation characteristics of the photoconductor and must adhere well to the photoconductive layer. Suitable organic polymers for use in the protective barrier include polyacrylates, polymethacrylates, polycarbonates, polyurethanes, polyvinyl acetals, sulfonated polyesters, and mixtures of polyvinyl alcohol with methylvinylether/maleic anhydride copolymer. The organic polymer may also contain additives, such as slip agents, antioxidants, surfactants, crosslinking agents, antistats, lubricants, and stabilizers.

The invention will now be illustrated in the following non-limiting examples:

EXAMPLES

The ring coating process used in the following examples is described in Borsenberger, P. S. and D. S. Weiss, *Organic*

*Photoreceptors for Imaging Systems*, Marcel Dekker, Inc., New York, p 294 (1993 ).

Unless designated otherwise, all materials are available from Aldrich Chemical, Milwaukee, Wis. The following preparations were used to prepare materials not commercially available.

Synthesis of Acrylic Dispersing Polymer M

A mixture of 128.0 g methyl methacrylate, 38.0 g isobutyl methacrylate, 30.0 g hydroxypropylacrylate (available from Dow Chemical Co., Midland, Mich.), 2.0 g QDM-R monomer (quaternary ammonium chloride methacrylate monomer, available from Nitto Chemical Industry Co. Ltd., Tokyo, Japan) in 20 g of ethanol and 2.0 g azobisisobutylnitrile initiator (Vazo-64, available from DuPont Chemicals, Wilmington, Del.) in 280.0 g methyl ethyl ketone (MEK) was mixed well in a brown bottle with a tight screw cap. The bottle was tumbled in a constant temperature water bath at 60° C. for 62 hours giving rise to a clear, viscous, pale yellow polymer solution. The percent total solids was determined to be 40%, equating to a quantitative conversion of the monomers. No residual monomer odor could be detected.

Synthesis of acrylic dispersing polymer N

A combination of 100 g methyl methacrylate, 131.3 g butyl acrylate, 12.5 g hydroxybutyl acrylate, 3.75 g QDM-R monomer (quaternary ammonium chloride methacrylate monomer available from Nitto Chemical Industry Co. Ltd., Tokyo, Japan) in 20 g ethanol, 2.5 g azobisisobutylnitrile initiator (Vazo-64, available from DuPont Chemicals, Wilmington, Del.) and 355 g of methyl ethyl ketone was mixed well in a brown bottle with a tight screw cap. The bottle was tumbled in a constant temperature water bath at 60° C for 62 hours giving rise to a clear, viscous, pale yellow polymer solution. The percent total solids was determined to be 40% equating to a quantitative conversion of the monomers. No residual monomer odor could be detected.

Example 1

The following example illustrates the effect of a tetraalkyl quaternary ammonium pendant group in a dispersing polymer with a phthalocyanine pigment dispersed in a tetrahydrofuran solvent.

The following two X-phthalocyanine pigment dispersion millbases were prepared using a sandmill equipped with 0.8 mm ceramic milling media.

| Ingredients | Millbase A | Millbase B |
|---|---|---|
| X-Phthalocyanine pigment (available from Zeneca Corp., Wilmington, DE) | 150 g | 150 g |
| Mowital ™ B60HH (poly(vinylbutyral) resin, available from Hoechst Celanese, Charlotte, NC; 15% by weight in tetrahydrofuran) | 1500 g | 900 g |
| EC-130 (Quaternary ammonium vinyl chloride copolymer, available from Sekisui Chemical Co. Ltd, Osaka, Japan; 15% by weight in tetrahydrofuran) | 0 g | 600 g |
| Tetrahydrofuran (THF) | 850 g | 850 g |

After milling the dispersion for approximately 18 hours, samples of the dispersion were evaluated under 200× magnification. Millbase A appeared to be quite grainy and non-uniform; while Millbase B was very smooth and uniform.

Millbases A and B were further evaluated by incorporating the millbases into an organic photoconductor construction. Additional Mowital™ was added to each of the millbases to achieve a 17% by weight X-phthalocyanine pigment loading and then diluted to 12% total solids with THF.

| Ingredients | Coating Solution A | Coating Solution B |
|---|---|---|
| Millbase A (15% by weight in THF) | 1500 g | |
| Millbase B (15% by weight in THF) | | 1500 g |
| Mowital ™ B60HH (poly(vinylbutyral) resin, available from Hoechst Celanese, Charlotte, NC; 15% by weight in THF) | 2027 g | 2027 g |
| Tetrahydrofuran (THF) | 885 g | 885 g |

Each of the coating solutions were filtered through 5 micron absolute fillers (Porous Media Corp., St. Paul, Minn.) and coated onto a 4 rail aluminum vapor coated polyester substrate at 50.8 cm/min. (20 feet/min.) using an extrusion die coater. The coatings were air dried in-line at 182.2° C. (360° F.) at a 1 minute residence time, giving rise to a dry coating thickness of approximately 7.5–8.0 microns.

The materials were tested by cutting 30.5 cm ×50.8 cm (12 inches ×20 inches) sample sheets and wrapping them around an aluminum drum. The periphery of the rotating drum had in the following order a 715 nm LED erase lamp, a corona charging device (600 volt grid, 600 microamps current), a 15 milliwatt 780 nm laser diode (available from Toshiba America, Inc., Irvine, Calif.), and two 0.6 cm (0.25 inch) wide sensors (Isoprobe™ electrostatic voltmeter, Model 166-1, probe Model 610, available from Monroe Electronics Inc., Lyndonville, N.Y.). The corona charging device is a scorotron type. The high voltage wires are coupled to a suitable positive high voltage source of +4000 to +8000 V. The grid wires are disposed about 1–3 mm from the photoreceptor surface and are coupled to an adjustable positive voltage supply to obtain an apparent surface voltage on the unexposed photoreceptor in the range +600 to +1000 V. The rotation speed of the drum was set at 7.6 cm/sec. (3 inches/sec.). The first sensor was located at a 0.1 second lag time from the laser exposure and the second sensor was located at a 1.2 second lag time from the laser exposure. Table I summarizes the electrostatic discharge for each of the samples measured at the first sensor after exposing at three different laser power settings.

TABLE 1

| | | Discharge, $V_{dis}$ | | |
|---|---|---|---|---|
| Sample No. | Charge, $V_{acc}$ | 0.5 mW | 1.5 mW | 2.5 mW |
| 1A | 835 | 560 | 100 | 70 |
| 1B | 760 | 80 | 60 | 50 |

The results in Table I clearly show that Sample 1B is more photosensitive than Sample 1 A, especially at the lower laser power settings. The larger the difference between the initial charge of the photoconductor and the discharged potential, the better the differentiation of the image and non-image areas of the photoconductor. Therefore, the use of a quaternary ammonium salt resin in the photoconductor coating provides better performance by producing better image resolution.

Example 2

The following example illustrates the effect the solvent plays in the quality of the dispersion. The following two X-phthalocyanine pigment dispersion mill bases were prepared using a sandmill equipped with 0.8 mm ceramic milling media.

| Ingredients | Millbase C | Millbase D |
|---|---|---|
| X-Phthalocyanine pigment (available from Zeneca Corp., Wilmington, DE) | 150 g | 150 g |
| Mowital ™ B60HH (poly(vinylbutyral) resin, available from Hoechst Celanese, Charlotte, NC; 15% by weight in methyl ethyl ketone) | 1500 g | 1125 g |
| EC-130 (Quaternary ammonium vinyl chloride copolymer, available from Sekisui Chemical Co. Ltd., Osaka, Japan; 15% by weight in methyl ethyl ketone) | 0 g | 375 g |
| Methyl ethyl ketone | 694 g | 694 g |

After milling the dispersion for 24 hours, samples of the dispersion were evaluated under 22× magnification. Millbase C appeared very grainy and non-uniform; where Millbase D was very smooth and uniform.

Millbases C and D were further evaluated by incorporating the millbases into an organic photoconductor construction. Additional Mowital™ was added to each of the milibases to achieve a 16% by weight X-phthalocyanine pigment loading and then diluted to 10% total solids with MEK.

| Ingredients | Coating Solution C | Coating Solution D |
|---|---|---|
| Millbase C (16% by weight in MEK) | 300 g | |
| Millbase D (16% by weight in MEK) | | 300 g |
| Mowital ™ B60HH (poly(vinylbutyral) resin, available from Hoechst Celanese, Charlotte, NC; 15% by weight in MEK) | 480 g | 480 g |
| Methyl ethyl ketone (MEK) | 420 g | 420 g |

The coating solutions were filtered through a 5 micron absolute filters (Porous Media Corp., St. Paul, Minn.) and coated onto 4 mil aluminum vapor coated polyester 30.5 cm ×50.8 cm (12 inches ×20 inches) sheets wrapped around an aluminum drum, using a ring coater. A dry coating weight of approximately 7.5–8.0 microns was achieved after drying at 150° C. (302° F.) for 2 hours. When tested for electrostatics on the tester described in Example 1, both Examples 2C and 2D charged up to 900V even with corona grid voltage set at only 300 v. Considerable arcing was observed, indicating that the coatings were highly insulative. When exposed to the laser at 2.5 mW power, no discharge was observed at the first sensor (0.1 sec) or the second sensor (1.2 sec); indicating total loss of photoconductivity due to the Mowital™/X-phthalocyanine pigment and Mowital™/EC-130/X-phthalocyanine pigment dispersions being milled in MEK solvent in contrast to excellent photoconductivity observed in THF solvent (Example 1).

Example 3

The following example illustrates the use of an acrylic resin as a binder in MEK. An X-phthalocyanine pigment dispersion millbase was prepared by milling the following ingredients in a sandmill equipped with 0.8 mm ceramic milling media.

| | |
|---|---|
| X-Phthalocyanine pigment (available from Zeneca Corp., Wilmington, DE) | 75 g |
| Elvacite ™ 2045 (acrylic resin, available from DuPont, Wilmington, DE; 33.8% by weight in MEK) | 518 g |
| Methyl ethyl ketone (MEK) | 440 g |

After milling the dispersion for 20 hours, a sample of the dispersion was evaluated under 200× magnification. The sample appeared very grainy and non-uniform. This is not surprising since Elvacite™ has no functional groups to wet out the surface of the pigment. The dispersion was further evaluated by incorporating the milibase into a photoconductor construction. A coating solution was prepared by adding the following ingredients in order:

| | |
|---|---|
| X-Phthalocyanine/Elvacite ™ millbase (prepared above) | 50 g |
| Elvacite ™ 2045 (acrylic resin, available from DuPont, Wilmington, DE; 33.8% by weight in MEK) | 34 g |
| Tinuvin ™ 770 (available from Ciba Geigy, Hawthorne, NY) | 0.61 g |
| Methyl ethyl ketone (MEK) | 76 g |

The dispersion was very unstable and agglomerated in 2–3 hrs upon standing. The suspension also agglomerated when an attempt was made to filter it though a 10 micron disc filter using a peristalic pump. The solution was quickly coated (without filtration) onto a 0.1 mm (4 mil) aluminum vapor coated polyester sheet wrapped around a drum using a ring coater. A dry coating thickness of approximately 6.0 microns was achieved after drying at 150° C. for 2 hours. Table 2 summarizes the results observed when the dried sample was cycled for 100 cycles on the electrostatic tester described in Example 1.

TABLE 2

| Number of Cycles | $V_{acc}$* | $V_{dis}$** (at 1.2 sec) | $t_{1/2}$*** seconds |
|---|---|---|---|
| 1 | 550 v | 110 v | 14 |
| 100 | 520 v | 105 v | 9 |

*$V_{acc}$ is the initial voltage observed upon charging with the corona.
**$V_{dis}$ is the discharged voltage observed 1.2 seconds after exposure with the laser.
***$t_{1/2}$ is the time for the initial voltage to drop to half its value The dark decay (t½) was found to degrade, as expected for the grainy marginally stable dispersion milled with a low viscosity binder such as Elvacite™2045 having no self-wetting characteristics. However, it important to note that good photoconductivity of a X-Phthalocyanine/acrylic dispersion in MEK can be achieved by sandmilling to an appropriate particle size/distribution.

Example 4

The following example illustrates the effect of using an acrylic binder having a self-wetting component on the dispersion quality and photoconductor performance. The following two X-phthalocyanine pigment dispersion milibases were prepared using a sandmill equipped with 0.8 mm ceramic milling media.

| Ingredients | Millbase E | Millbase F |
|---|---|---|
| X-Phthalocyanine pigment (available from Zeneca Corp.. Wilmington, DE) | 100 g | 100 g |
| Acrylic Dispersing Polymer M (40% by weight in MEK) | 375 g | 225 g |
| Mowital ™ B60HH (poly(vinylbutyral) resin, available from Hoechst Celanese, Charlotte, NC; 15% by weight in methyl ethyl ketone) | 0 | 400 g |
| Methyl ethyl ketone (MEK) | 1448 g | 1198 g |

Millbase E was milled for 10 hours and Millbase F was milled for 24 hours. Samples of each of the dispersions was evaluated under 200× magnification. Millbase F appeared to be fairly uniform and slightly grainy compared to the excellent uniformity and smooth texture of millbase E. Both of the dispersion millbases (at 13% total solids and 40% X-Phthalocyanine pigment loading) were stable towards agglomeration for at least two weeks. The dispersions were further evaluated by incorporating the millbases into a photoconductor construction. Comparative solutions were prepared by combining the following materials in the order listed:

| Ingredients | Solution 4E | Solution 4F |
|---|---|---|
| Example E Millbase (13% by weight in MEK) | 100 g | |
| Example F Millbase (13% by weight in MEK) | | 100 g |
| Acrylic Dispersing Polymer M (40% by weight in MEK) | 7.0 g | 14.8 g |
| Mowital ™ B60HH (poly(vinylbutyral) resin, available from Hoechst Celanese, Charlotte, NC; 15% by weight in methyl ethyl ketone) | 91.0 g | 70.2 g |
| Tinuvin ™ 770 (available from Ciba Geigy, Hawthorne, NY) | 0.273 g | 0.273 g |
| Methyl ethyl ketone (MEK) | 27 g | 27 g |

The solutions 4E and 4F were filtered through 5 micron absolute filters (Porous Media Corp., St. Paul, Minn.). A final coating solution was prepared by combining the following ingredients immediately before coating:

| Ingredients | Final Coating Solution 4E | Final Coating Solution 4F |
|---|---|---|
| Coating Solution 4E (filtered) | 200 g | |
| Coating Solution 4F (filtered) | | 200 g |
| Mondur ™ CB-601 (isocyanate crosslinker, available from Mobay Corp., Pittsburg, PA; 60% total solids) | 3.64 g | 3.64 g |
| Dibutyl tin dilaurate catalyst | 0.044 g | 0.044 g |
| Methyl ethyl ketone (MEK) | 16 g | 16 g |

The final coating solutions were coated onto 4 rail aluminum vapor coated polyester sheets using a ring coater. After drying at 150° C. for 1 hour the photoconductor sheets were tested for electrostatic discharge on the tester described in Example 1. Example 4E showed excellent photoconductivity; however, Example 4F exhibited no laser discharge even though the final binder was almost identical in both Examples 4E and 4F. Table 3 summarizes the results observed.

TABLE 3

| Example | $V_{acc}$* | $V_{dis}$** (at 0.1 sec) | $V_{dis}$** (at 1.2 sec) |
|---|---|---|---|
| 4E | 700 v | 60 v | 40 v |
| 4F | 750 v | 750 v | 750 v |

*$V_{acc}$ is the initial voltage observed upon charging with the corona.
**$V_{dis}$ is the discharged voltage observed at the designated lag time after exposure with the laser.

The effect of having Mowital™ (poly(vinylbutyral)) present during milling suggests that certain binder/X-Phthalocyanine combinations can give different morphology when coated out of MEK, compared to other solvents such as THF. The problem can be overcome by first milling the X-Phthalocyanine/MEK dispersion with only the modified acrylic polymer and then adding any other "solvent-sensitive" binder such as Mowital™ B60HH at the coating solution preparation stage.

This clearly demonstrates the importance of controlling X-Phthalocyanine pigment particle size/distribution as well as binder/pigment morphology, and delineates the requirement of any "molecularly dissolved" X-Phthalocyanine state for good organic photoconductor performance as taught in U.S. Pat. No. 5,087,540.

Example 5

The following example further illustrates the effect of using an acrylic binder having a self-wetting component on the dispersion quality and photoconductor performance. A X-phthalocyanine pigment dispersion millbase was prepared by combining the following ingredients and milling the mixture in a sandmill equipped with 0.8 mm ceramic milling media:

| | |
|---|---|
| X-Phthalocyanine pigment (available from Zeneca Corp. Wilmington, DE) | 120 g |
| Acrylic Dispersing Polymer N (40% by weight in MEK) | 200 g |
| Methyl ethyl ketone (MEK) | 1680 g |

After milling for 14 hours, a sample of the dispersion was evaluated under 200× magnification. The dispersion appeared extremely smooth and uniform. Additional Mowital™ B60HH (1476 g; 15% by weight in MEK) was added to 1700 g of millbase (9.3% total solids) to prevent any possible agglomeration of the high pigment concentrated millbase. The resulting dispersion at 25% by weight X-Phthalocyanine pigment content and 12% total solids in methyl ethyl ketone was stable for several months. The dispersion was further evaluated by incorporating the stabilized millbase into a photoconductor construction.

A suspension was prepared by combining the following ingredients in the order listed:

| | |
|---|---|
| Modified Millbase described above (12% total solids in MEK) | 3155 g |
| Mowital ™ B60HH (poly(vinylbutyral) resin, available from Hoechst Celanese, Charlotte, NC; 15% by weight in methyl ethyl ketone) | 1390 g |
| Tinuvin ™ 770 (available from Ciba Geigy, Hawthorne, NY) | 16.1 g |
| PM Acetate solvent (Propylene glycol monomethyl ether acetate) | 463 g |
| Methyl ethyl ketone (MEK) | 90 g |

The suspension was filtered through 5 micron absolute filter (Porous Media Corp., St. Paul, Minn.). A final coating solution was prepared by combining the following ingredients immediately before coating:

| | |
|---|---|
| Filtered pigment suspension prepared above | 5000 g |
| Mondur ™ CB-601 (Toluene diisocyanate crosslinker, available from Mobay Corp., Pittsburg, PA; 60% total solids) | 42.5 g |
| Dibutyl tin dilaurate catalyst | 1.0 g |
| Methyl ethyl ketone (MEK) | 95 g |

The final coating solution was in-line coated onto a 30.5 cm (12 inch) wide aluminum vapor coated 0.1 mm (4 mil) polyester substrate using a web coater. The coating solution was filtered through a 20 micron absolute filter (Porous Media Corp., St. Paul, Minn.) as it was fed to the extrusion coater. The coating was dried at 132° C. (270° F.) at an approximate 5 minute dwell time in a hot air oven, giving rise to an approximate 7.5 micron dry coating thickness.

A 50.8 cm (20 inch) sample sheet was tested using the same procedure as described in Example 1. The sample charged up to 670 volts and laser discharged to 30 volts in 0.1 see and 20 volts in 1.2 see after laser exposure (2.5 mW, 90% duty cycle). The dark decay was also very low, dropping to only 80% of the original voltage in 90 seconds.

The organic photoconductor coating was over-coated with a polymeric protective barrier layer solution. The protective barrier layer solution was prepared by combining the following ingredients in the order listed:

| | |
|---|---|
| Acryloid ™ AU 608 (acrylic copolymer, available from Rohm & Haas Co., Philadelphia, PA; 49.1% by weight in propylene methylethylacetate/toluene) | 125.3 g |
| Tinuvin ™ 770 (stabilizer, available from Ciba Geigy Corp., Hawthorne, NY) | 2.25 g |
| Mondur ™ CB-601 (Toluene diisocyanate crosslinker, available from Mobay corp., Pittsburg, PA; 60% total solids) | 18.13 g |
| Dibutyl tin dilaurate | 0.38 g |
| Cyclohexanone | 243 g |
| Methyl ethyl ketone (MEK) | 2111 g |

The solution was filtered through a 5 micron absolute filter (available from Porous Media Corp., St. Paul, Minn.) before coating and again in line through a 20 micron absolute filter (available from Porous Media Corp., St. Paul, Minn.) at the time of coating. The solution flow rate was adjusted to achieve a dry thickness of 0.2 micron. A sample of the dried construction was tested on the tester described in Example 1. Excellent electrostatic performance was observed with the material charging up to 640 volts and laser discharging to 225 volts in 0.1 sec and 50 volts in 1.2 sec after laser exposure. Although the residual voltage was higher than for the photoconductor with out the protective barrier layer, the contrast ($640(V_{acc})-50(V_{dis})$ =590 volts) was sufficient for good image quality. The dark decay was again very low, dropping to only 80–85% of the initial voltage in 90 seconds. The sample also showed excellent cycle durability and gave high resolution, when imaged with liquid toners, after coating the sample with a silicone release layer over the protective barrier layer.

Reasonable variations and modifications are possible from the foregoing disclosure without departing from either the spirit or scope of the invention as claimed.

What is claimed:

1. A method for producing an organic photoconductor comprising the steps of;

a) preparing a photoconductive layer solution by combining a phthalocyanine pigment dispersion comprising: i)a phthalocyanine pigment, ii) a dispersing polymer comprising a polymeric material having a plurality of pendant quaternary ammonium salt groups, and iii) an organic solvent, with a binder and a crosslinking agent;

b) coating said photoconductive layer solution on an electroconductive substrate to form a coating;

c) drying said coating; and d) crosslinking said coating.

2. The method of claim 1 wherein said binder is poly(vinylbutyral).

3. The method of claim 1 wherein said crosslinking agent is an isocyanate compound.

4. The method of claim 1 wherein said dispersing polymer comprises an alkyl acrylate monomer unit, an alkyl methacrylate monomer unit, a hydroxyalkyl acrylate monomer unit, and an alkyl methacrylate monomer unit having a pendant quaternary ammonium salt group.

5. The method of claim 4 wherein said alkyl acrylate monomer unit comprises 10 to 60% by weight of said dispersing polymer.

6. The method of claim 4 wherein said alkyl acrylate monomer unit comprises 20 to 50% by weight of said dispersing polymer.

7. The method of claim 4 wherein said alkyl methacrylate monomer unit comprises 10 to 50% by weight of said dispersing polymer.

8. The method of claim 4 wherein said alkyl methacrylate monomer unit comprises 20 to 40% by weight of said dispersing polymer.

9. The method of claim 4 wherein said hydroxyalkyl acrylate monomer unit comprises 3 to 30% by weight of said dispersing polymer.

10. The method of claim 4 wherein said hydroxyalkyl acrylate monomer unit comprises 5 to 15% by weight of said dispersing polymer.

11. The method of claim 4 wherein said alkyl methacrylate monomer unit having a pendant quaternary ammonium salt group comprises 0.5 to 5% by weight of said dispersing polymer.

12. The method of claim 4 wherein said alkyl methacrylate monomer unit having a pendant quaternary ammonium salt group comprises 1 to 3% by weight of said dispersing polymer.

13. The method of claim 4 wherein said methacrylate monomer unit having a pendant quaternary ammonium salt group having the formula:

$$H_2C{=}\overset{\overset{CH_3}{|}}{C}{-}\overset{\overset{O}{||}}{C}{-}O(CH_2)_nN^+(CH_3)_2R^1\,X^-$$

where; n is 1 to 20; $R^1$ is an alkyl group having 1 to 30 carbons; and X is a counter anion.

14. The method of claim 13 wherein said counter anion is selected from the group consisting of chloride, bromide and iodide.

15. The method of claim 2 wherein said crosslinking step is accomplished by heating said coating.

16. The method of claim 2 wherein said crosslinking step is accomplished by irradiating said coating with electromagnetic radiation.

* * * * *

UNITED STATES PATENT AND TRADEMARK OFFICE

CERTIFICATE OF CORRECTION

PATENT NO. : 5,597,675

DATED : January 28, 1997

INVENTOR(S) : Ravindra L. Arudi, et. al.

It is certified that error appears in the above-indentified patent and that said Letters Patent is hereby corrected as shown below:

On title page, item [73] should read as follows:
--Minnesota Mining and Manufacturing Company, St. Paul, Minn.--

Signed and Sealed this

Twenty-sixth Day of August, 1997

*Attest:*

Bruce Lehman

BRUCE LEHMAN

*Attesting Officer*

*Commissioner of Patents and Trademarks*